US006786619B2

(12) United States Patent
Subisak et al.

(10) Patent No.: US 6,786,619 B2
(45) Date of Patent: Sep. 7, 2004

(54) REFLECTOR/REFRACTOR LIGHT CONTROL LUMINAIRE

(75) Inventors: Gregory J. Subisak, Gahanna, OH (US); Herbert A. Fouke, Newark, OH (US)

(73) Assignee: Acuity Brands, Inc., Atlanta, GA (US)

( * ) Notice: Subject to any disclaimer, the term of this patent is extended or adjusted under 35 U.S.C. 154(b) by 88 days.

(21) Appl. No.: 10/280,281

(22) Filed: Oct. 25, 2002

(65) Prior Publication Data

US 2004/0080947 A1 Apr. 29, 2004

(51) Int. Cl.[7] ..... F21V 7/04; F21V 5/04

(52) U.S. Cl. ..... 362/308; 362/309; 362/329; 362/334; 362/348

(58) Field of Search ..... 362/311, 332, 362/335, 363, 309, 310, 328, 334, 340, 308, 299, 327, 329, 348, 346

*Primary Examiner*—Alan Cariaso
*Assistant Examiner*—Guiyoung Lee
(74) *Attorney, Agent, or Firm*—Kenneth E. Darnell

(57) ABSTRACT

A luminaire globe member formed of light transmissive material and having a reflector section and a refractor section, light from a light source such as a high intensity discharge lamp initially impinging on at least major portions of the reflector section being reflected back into the interior of the globe member by prisms preferably disposed on exterior surfaces of said reflector section, refractive prisms preferably disposed on interior surfaces of the reflector section redirecting said reflected light through a focal point or loci of points directly above the light source, the light thus redirected from the reflector section being incident on surfaces of the refractor section at angles similar to angles of incidence of light rays directly emanating from the light source and directly incident on said refractor section surfaces, thereby to increase light efficiency by virtue of improved light control within the globe member.

32 Claims, 18 Drawing Sheets

| PRISM NUMBER | A | B | PRISM HEIGHT | X | PRISM NUMBER | A | B | PRISM HEIGHT | X |
|---|---|---|---|---|---|---|---|---|---|
| 50 | 35 | 13 | .103 | .087 | 81 | 88.2 | 1.5 | .185 | 6.14 |
| 51 | 35 | 13 | .120 | .31 | 82 | 89.4 | 1.5 | .190 | 6.32 |
| 52 | 35 | 13 | .120 | .55 | 83 | 90.6 | 1.5 | .180 | 6.51 |
| 53 | 35 | 13 | .120 | .79 | 84 | 91.8 | 1.5 | .185 | 6.69 |
| 54 | 35 | 13 | .120 | 1.03 | 85 | 93.0 | 1.5 | .185 | 6.88 |
| 55 | 35 | 13 | .120 | 1.27 | 86 | 94.2 | 1.5 | .185 | 7.06 |
| 56 | 35 | 13 | .120 | 1.51 | 87 | 95.4 | 1.5 | .185 | 7.25 |
| 57 | 35 | 13 | .110 | 1.74 | 88 | 96.6 | 1.5 | .185 | 7.43 |
| 58 | 35 | 13 | .110 | 1.96 | 89 | 97.8 | 1.5 | .185 | 7.62 |
| 59 | 35 | 13 | .110 | 2.18 | 90 | 99.0 | 1.5 | .185 | 7.80 |
| 60 | 35 | 13 | .110 | 2.40 | 91 | 100 | 1.5 | 185 | 7.99 |
| 61 | 63.8 | 1.5 | .130 | 2.61 | 92 | 101 | 1.5 | .185 | 8.17 |
| 62 | 64.5 | 1.5 | .130 | 2.74 | 93 | 101.5 | 1.5 | .185 | 8.36 |
| 63 | 65.2 | 1.5 | .160 | 2.87 | 94 | 102 | 1.5 | 185 | 8.54 |
| 64 | 66.6 | 1.5 | .160 | 3.03 | 95 | 102.5 | 1.5 | .185 | 8.73 |
| 65 | 68 | 1.5 | .170 | 3.19 | 96 | 103 | 1.5 | .185 | 8.91 |
| 66 | 69.4 | 1.5 | .185 | 3.36 | 97 | 103.5 | 1.5 | .186 | 9.10 |
| 67 | 70.6 | 1.5 | .185 | 3.55 | 98 | 104 | 1.5 | .185 | 9.28 |
| 68 | 71.8 | 1.5 | .185 | 3.73 | 99 | 104.5 | 1.5 | .185 | 9.465 |
| 69 | 73 | 1.5 | .185 | 3.92 | 100 | 105 | 1.5 | .185 | 9.650 |
| 70 | 74.2 | 1.5 | .185 | 4.10 | 101 | 105.5 | 1.5 | .183 | 9.835 |
| 71 | 75.5 | 1.5 | .185 | 4.29 | 102 | 106 | 1.5 | .183 | 10.018 |
| 72 | 76.8 | 1.5 | .185 | 4.47 | 103 | 106.5 | 1.5 | .183 | 10.201 |
| 73 | 78.1 | 1.5 | .185 | 4.66 | 104 | 107 | 1.5 | .183 | 10.384 |
| 74 | 79.4 | 1.5 | .185 | 4.84 | 105 | 107.5 | 1.5 | .183 | 10.567 |
| 75 | 80.7 | 1.5 | .185 | 5.03 | 106 | 18 | 45 | .180 | 10.750 |
| 76 | 82 | 1.5 | .185 | 5.21 | 107 | 19 | 33 | .178 | 10.930 |
| 77 | 83.3 | 1.5 | .185 | 5.40 | 108 | 19 | 32 | .178 | 11.108 |
| 78 | 84.6 | 1.5 | .185 | 5.58 | 109 | 27 | 31 | .178 | 11.286 |
| 79 | 85.8 | 1.5 | .185 | 5.77 | | | | | |
| 80 | 87 | 1.5 | .185 | 5.95 | | | | | |

*Fig. 10*

| PRISM NUMBER | A | B | PRISM HEIGHT | Y | PRISM NUMBER | A | B | PRISM HEIGHT | Y |
|---|---|---|---|---|---|---|---|---|---|
| 300 | 2 | – | .1875 | 0 | 332 | 18 | 4 | .14 | 5.7725 |
| 301 | 2 | – | .1875 | 0.1875 | 333 | 17 | 4 | .14 | 5.9125 |
| 302 | 2.5 | – | .1875 | 0.3750 | 334 | 16 | 4 | .14 | 6.0525 |
| 303 | 2.5 | – | .1875 | 0.5625 | 335 | 15 | 0 | .14 | 6.1925 |
| 304 | 3 | – | .1875 | 0.7500 | 336 | 14 | 0 | .14 | 6.3325 |
| 305 | 3.5 | – | .1875 | 0.9375 | 337 | 13 | 0 | .14 | 6.4725 |
| 306 | 4 | – | .1875 | 1.1250 | 338 | 57 | 41 | .14 | 6.6125 |
| 307 | 4.5 | – | .1875 | 1.3125 | 339 | 56 | 41 | .14 | 6.7525 |
| 308 | 40 | 34 | .1875 | 1.5000 | 340 | 53 | 41 | .115 | 6.8675 |
| 309 | 39 | 34 | .1875 | 1.6875 | 341 | 51 | 45 | .115 | 6.9825 |
| 310 | 38 | 34 | .1875 | 1.8750 | 342 | 49 | 45 | .115 | 7.0975 |
| 311 | 37 | 31 | .1875 | 2.0625 | 343 | 47 | 45 | .115 | 7.2125 |
| 312 | 36 | 31 | .1875 | 2.2500 | 344 | 40 | 33 | .115 | 7.3275 |
| 313 | 35 | 31 | .1875 | 2.4375 | | | | | |
| 314 | 35 | 29 | .1875 | 2.6250 | | | | | |
| 315 | 34 | 29 | .1875 | 2.8125 | | | | | |
| 316 | 34 | 29 | .1875 | 3.0000 | | | | | |
| 317 | 34 | 25 | .1875 | 3.1875 | | | | | |
| 318 | 34 | 25 | .1875 | 3.3750 | | | | | |
| 319 | 34 | 25 | .1875 | 3.5625 | | | | | |
| 320 | 34 | 22 | .1875 | 3.7500 | | | | | |
| 321 | 32 | 22 | .1875 | 3.9375 | | | | | |
| 322 | 30 | 22 | .1875 | 4.1250 | | | | | |
| 323 | 28 | 19 | .1875 | 4.3125 | | | | | |
| 324 | 26 | 19 | .1875 | 4.5000 | | | | | |
| 325 | 26 | 19 | .1875 | 4.6875 | | | | | |
| 326 | 26 | 13 | .1875 | 4.8750 | | | | | |
| 327 | 26 | 13 | .1875 | 5.0625 | | | | | |
| 328 | 26 | 13 | .15 | 5.2125 | | | | | |
| 329 | 24 | 11 | .14 | 5.3525 | | | | | |
| 330 | 22 | 11 | .14 | 5.4925 | | | | | |
| 331 | 20 | 11 | .14 | 5.6325 | | | | | |

*Fig. 12*

REFLECTOR/REFRACTOR LIGHT CONTROL LUMINAIRE

BACKGROUND OF THE INVENTION

1. Field of the Invention

The invention relates generally to reflector/refractor luminaire globe combinations and particularly to such combinations exhibiting increased utilization of light generated by controlling the angles of incidence of light rays incident on a refractor section of such a combination.

2. Description of the Prior Art

Reflector/refractor devices have long been available in the art and utilizable with a variety of lamping configurations to provide light distribution characteristics suitable for a number of lighting applications. Such reflector/refractor combinations have typically been formed of light transmissive materials such as glass, plastic materials such as acrylics, etc. Prisms and similar light altering structures are typically formed on both interior and exterior surfaces of prior reflector/refractor combinations in order to direct light from a contained lamp in a manner providing a desired level of light within a space that is to be illuminated. Reflector/refractor combinations are disclosed in a number of issued United States patents including U.S. Pat. No. 4,839,781 to Barnes et al, this patent disclosing the provision of a series of sectional zones on a reflector/refractor for reflecting and refracting light. The sectional zones of the Barnes et al reflector/refractor have formed thereon prisms having reflective, refractive or either reflective and refractive characteristics depending upon location relative to a light source, the reflective/refractive prisms and similar elements acting in combination to vary light distribution. The Barnes et al reflector/refractor, while formable from either glass or acrylic materials, for example, is preferably formed of light transmissive synthetic resin materials, such as, for example, an acrylic UVA5 or similar material such as by injection molding. The disclosure of U.S. Pat. No. 4,839,781 is incorporated hereinto by reference.

Fouke, in U.S. Pat. No. 6,027,231, discloses a reflector/refractor combination having prisms of varying kind disposed on surfaces thereof for a desired control of light generated within the interior of the combination by means of an HID lighting source. While the reflector/refractor of Fouke can be formed of either glass or plastic materials such as acrylic, the optical structure of Fouke is preferably formed of glass and the HID light source may constitute either a mercury, metal halide, or high pressure sodium lamp inter alia. Fouke also discloses prisms of differing configuration and kind useful in directing light in a desired direction. As such, the disclosure of U.S. Pat. No. 6,027,231 is incorporated hereinto by reference.

In U.S. Pat. No. 563,836, Blondel et al disclose a variety of configurations of lamp globes that are essentially reflector/refractor combinations, these lamp globes having differing arrangements of prisms, flutes and other light reflecting and/or refracting capabilities, the "globes, shades, reflectors, and other envelops" of Blondel et al being preferably formed of glass or similar light transmissive material. The prisms formed on the Blondel et al globes take a variety of forms having differing structure and light reflective and/or refractive capabilities chosen for use in particular situations for directing light in a desired direction. The disclosure of U.S. Pat. No. 563,836 is incorporated hereinto by reference.

Osteen, in U.S. Pat. Nos. 4,118,763 and 5,036,445, describes light transmissive globes used in luminaires and having prisms of differing description formed on said globes for controlling light direction and utilization, these patents being incorporated hereinto by reference. Harling, in U.S. Pat. No. 3,329,812, discloses a refractor arrangement having prismatic structures capable of directing light in a desired direction, this patent being incorporated hereinto by reference. Kelly et al, in U.S. Pat. No. 5,434,765, discloses a reflector/refractor combination intended to direct light downwardly by means of a judicious disposition of prismatic structures formed on said combination for the purpose of light control, this patent also being incorporated hereinto by reference.

The body of art developed in the lighting field as represented by the patents described above and by numbers of other patents as well as countless luminaires available in the marketplace over time have usually attempted to more efficiently utilize light generated by a light source contained, enclosed or otherwise associated with a light transmissive globe member forming the optical portion of luminaires configured according to the prior art. The present invention further intends improvement in the control of light within such globe members by directing light incident on major portions of a reflector section of such a globe member to a point or loci of points preferably located immediately above a light source such that the pattern of that light incident on the reflector section and onto an associated refractor section is similar to that light directly incident on the refractor section and emanating from the light source itself. Improved lighting control thus obtains to provide increased efficiency of light generated by the light source as well as a desired distribution of light from the luminaire.

SUMMARY OF THE INVENTION

The invention provides a light transmissive globe member having a reflector section and a refractor section enclosing a light source such as a gaseous discharge lamp and particularly a high intensity discharge (HID) lamp. Light produced by the light source emanates outwardly thereof from within the interior of the globe member toward essentially all surfaces of the globe member. That portion of the generated light emanating from lower, central and upper portions of the light source have a similar pattern of incidence on the refractor section of the present globe member. Major portions of the light emanating from the light source and incident on the reflector section, that is, at least over major portions of said reflector section, is incident on refractive prisms formed on interior surfaces of said reflector section and is refracted toward reflective prisms formed on outer surfaces of said reflector section. Light rays thereby incident on the reflective prisms are reflected back through the refractive prisms formed on inner surfaces of the reflector section and are refracted through a focal point or loci of points directly above the light source such that at least major portions of the light thus redirected from the reflector section is incident on at least major portions of the surfaces of the refractor section in a pattern similar to the patterns of that light emanating directly from the different portions of the light source and into direct contact with surfaces of the refractor section. By virtue of the similarity of angles of incidence of both direct light and redirected light onto refractor section surfaces, light emanating from the globe member of the invention can be more readily controlled for direction into space externally of the globe member to thereby increase the efficiency of light utilization generated by the light source.

It is therefore an object of the invention to provide a light transmissive globe member useful in a luminaire and having a reflector section functioning in combination with a refractor section so that light generated by a light source within the globe member and incident on the reflector section is redirected to form a pattern similar to light patterns of that light directly incident on the refractor section and emanating directly from the light source.

It is another object of the invention to provide a globe member formed of light transmissive material and useful in a luminaire for control of light generated by a light source contained within said globe member, the globe member being formed of a reflector section and a refractor section and functioning to control light direction by the reflection and refraction of light incident on the reflector section and emanating from the light source to a point or loci of points preferably located immediately above the light source such that a pattern of redirected light incident on at least portions of the refractor section is similar to patterns of light emanating from varying portions of the light source directly onto at least portions of the refractor section, thereby permitting control of light distribution and improvement of light utilization.

It is a further object of the invention to provide a globe member formed of light transmissive material for use in a luminaire for light control and having a reflector section and a refractor section cooperating to control light directed from the globe member, the reflector section and the refractor section being respectively formed with reflective/refractive prisms and refractive prisms on exterior surfaces thereof and configured to redirect light incident on at least major portions of the reflector section back into the interior of the globe member and through a focal point or loci of points and into incidence with at least major surface portions of the refractor section in a pattern similar to patterns of light emanating from differing portions of the light source and directly incident on said refractor section surfaces, thereby to control light distribution and improve lighting efficiency.

Further objects and advantages of the invention will become more readily apparent in light of the following detailed description of the preferred embodiments.

BRIEF DESCRIPTION OF THE DRAWINGS

FIG. 10 is a table detailing the characteristics of the refractive prisms illustrated in FIG. 9;

FIG. 12 is a table detailing the characteristics of the refractive prisms illustrated in FIG. 11;

DESCRIPTION OF THE PREFERRED EMBODIMENTS

Figure 1:
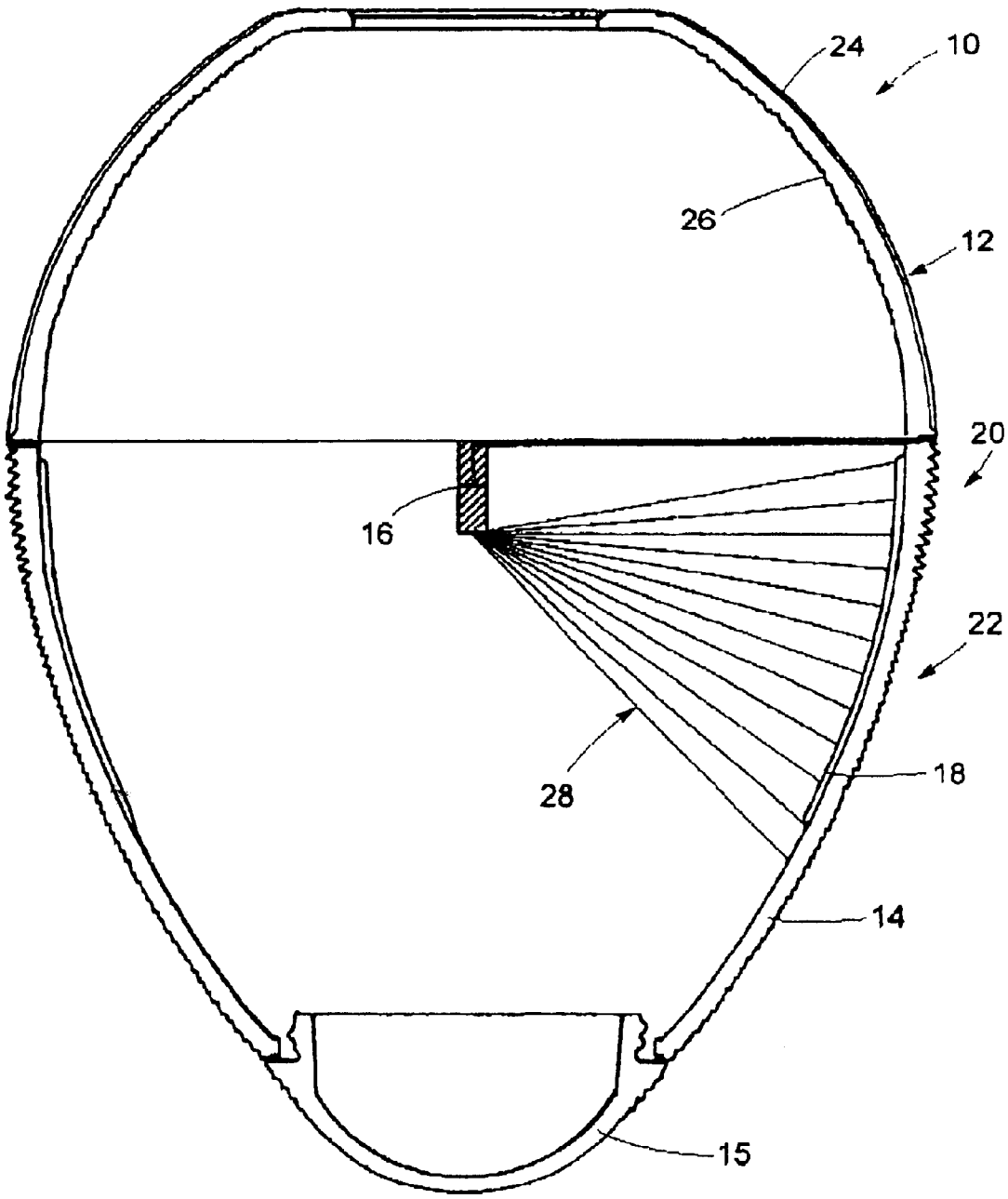
FIG. 1 is a schematic view representational of a light transmissive globe member forming a portion of a luminaire and illustrating a ray trace incident on portions of a refractor section of the globe member and emanating from a lower portion of a light source.
Figure 2:
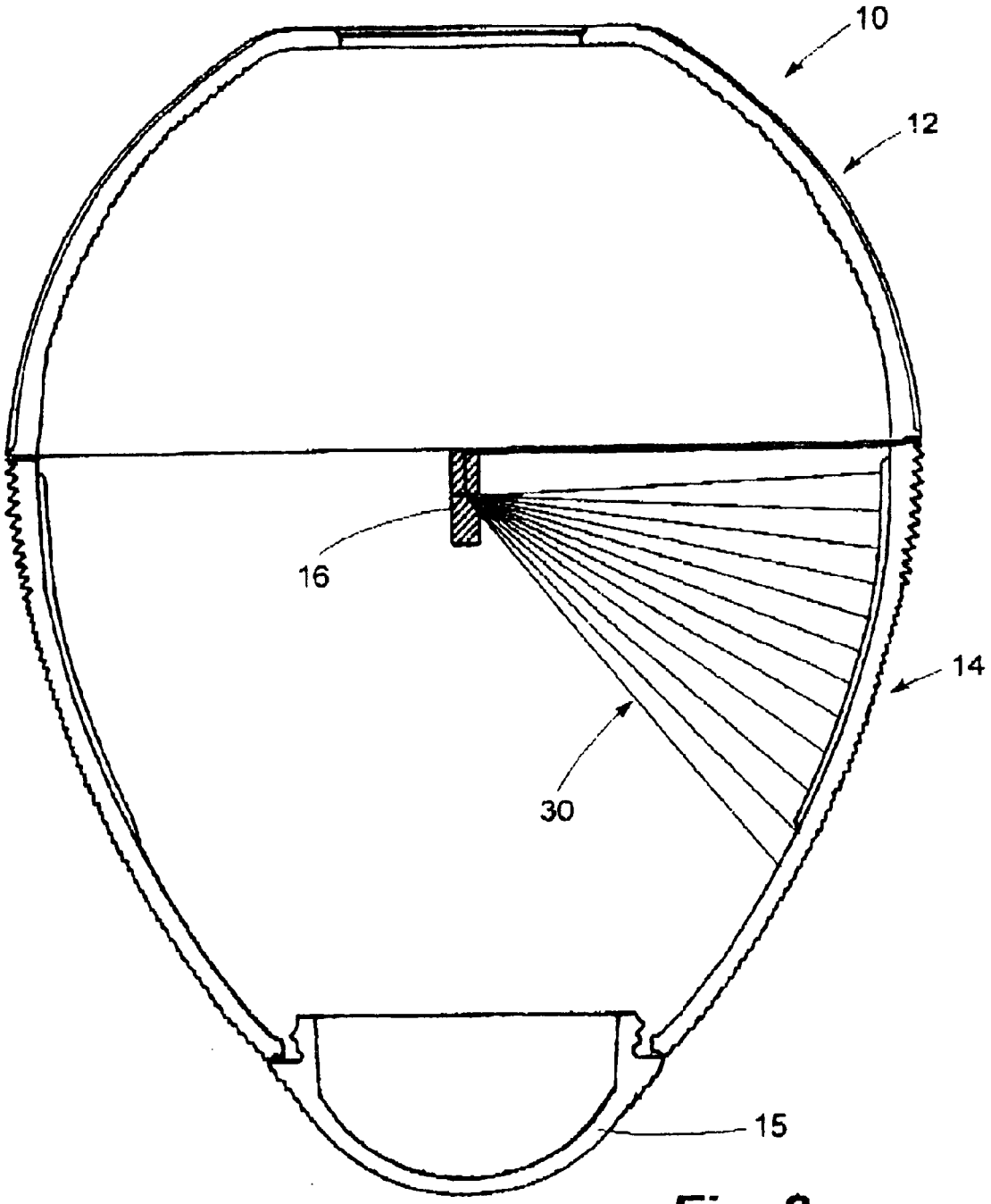
FIG. 2 is a schematic view representational of the globe member of FIG. 1 and illustrating a pattern of light similar to the pattern of light shown in FIG. 1 but emanating from a central portion of the light source.
Figure 3:
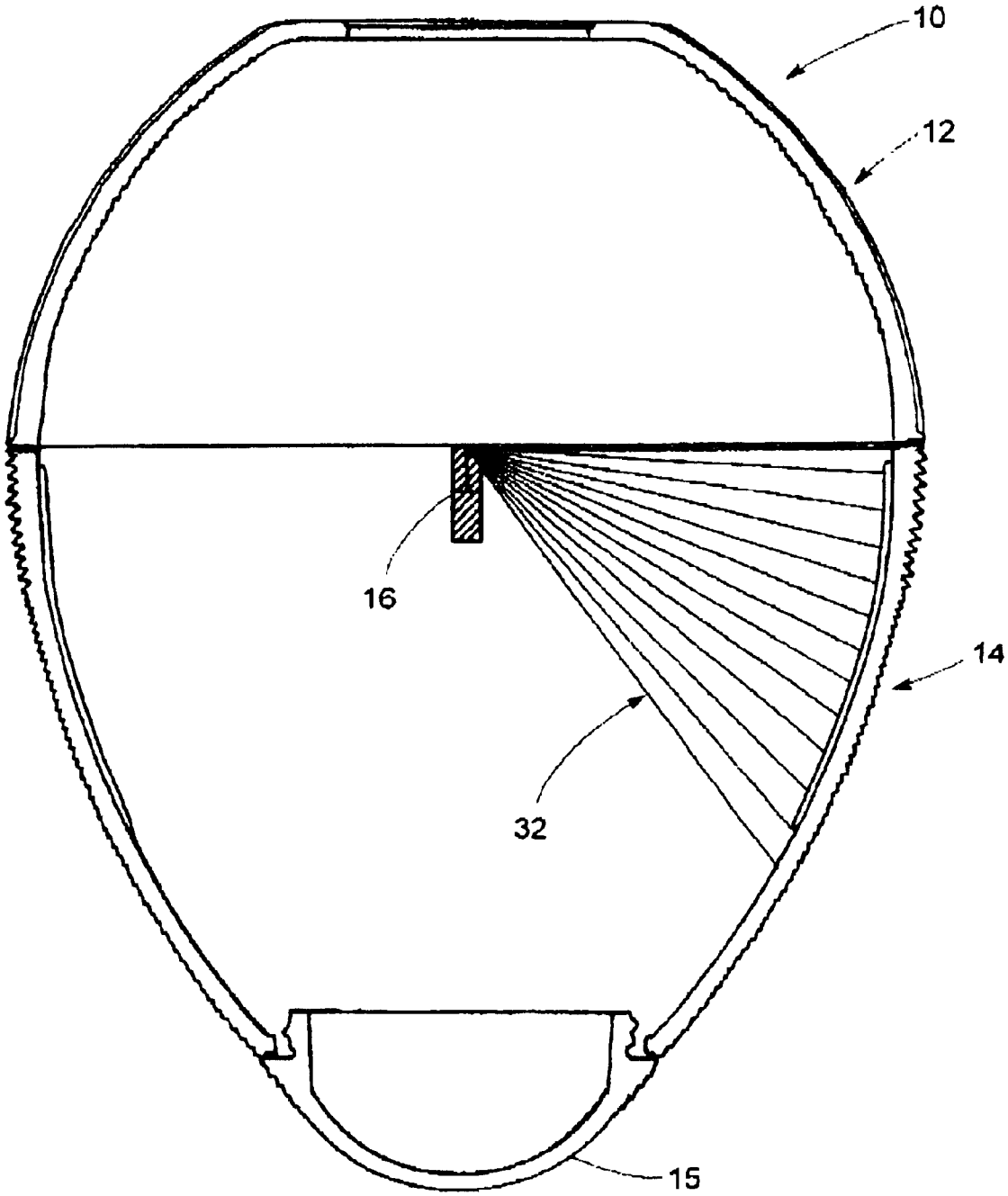
FIG. 3 is a schematic view representational of a ray trace such as is shown in FIGS. 1 and 2 but emanating from an upper portion of the light source.

Referring now to the drawings and particularly to FIGS. 1 through 3, a globe member 10 is seen to be comprised of a reflector section 12 and a refractor section 14, the sections 12, 14 being joined together either in a conventional fashion as desired or in a navel manner such as is described in co-pending U.S. patent application Ser. No. 10/280,280, entitled "Luminaire Globe Having Low Glare Bandless Seam", filed of even date and assigned to the present assignee, this application being incorporated hereinto by reference. The globe member 10 is completed by the attachment of door 15 to an open end of the refractor section 14, the provision of a door and an attachment therefor to the section 14 conveniently being conventional in nature. The globe member 10 is provided with a light source 16 substantially disposed centrally within the confines of the globe member 10, an upper end of the light source 16 being essentially disposed substantially at a level within the globe member 10 such that an upper portion of an arc tube of the light source 16 is essentially coincident with a plane of interconnection between said sections 12, 14. It is to be understood that the sections 12, 14 can be formed of glass and/or plastic materials such as acrylic in a conventional manner. Further, it is to be understood that the light source 16 typically comprises a gaseous discharge, fluorescent or incandescent lamp inter alia and preferably a high intensity discharge (HID) lamp, the representation of the light source 16 as seen in the drawings being essentially schematically shown for ease of illustration.

The refractor section 14 is seen to be provided with interior prisms 18 and with exteriorly formed prisms 20 and 22, the prisms 20 being preferably taken to be splitter prisms as are described in copending U.S. patent application, Ser. No. 10/280,279, entitled "Prismatic Structure, having Shaped Surfaces", filed of even, date and assigned to the present assignee, this application for patent being incorporated hereinto by reference. The prisms 20, 22 are refractive prisms and act to direct light incident thereon externally of the globe member 10 as will be described in more detail hereinafter. The prisms 18 can conveniently take the form of prisms as are shown in the Blondel patent, the prisms 18 acting to spread light laterally.

Figure 13:
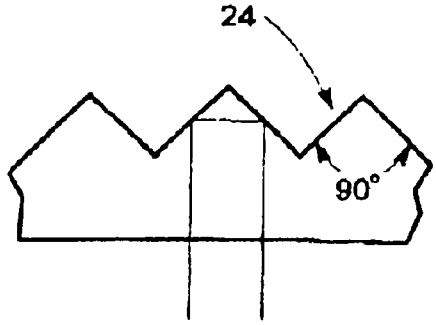
FIG. 13 is a detailed schematic illustrating the configuration of reflective prisms formed on exterior surfaces of a preferred embodiment of the refractor section of FIG. 1.

The reflector section 12 is seen to be formed with reflective prisms 24 formed on at least major portions of exterior surfaces thereof, said reflective prisms 24 functioning to reflect at least major portions of light incident thereon back into the interior of the globe member 10 and into incidence on refractive prisms 26 formed over major portions of interior surfaces of the section 12. The prisms 24, 26 are particularly configured for control of light within the globe member 10 as will be described in detail hereinafter. The prisms 24 can be formed as 90° prisms or angles thereabout that angular value as shown in FIG. 13.

Figure 8:
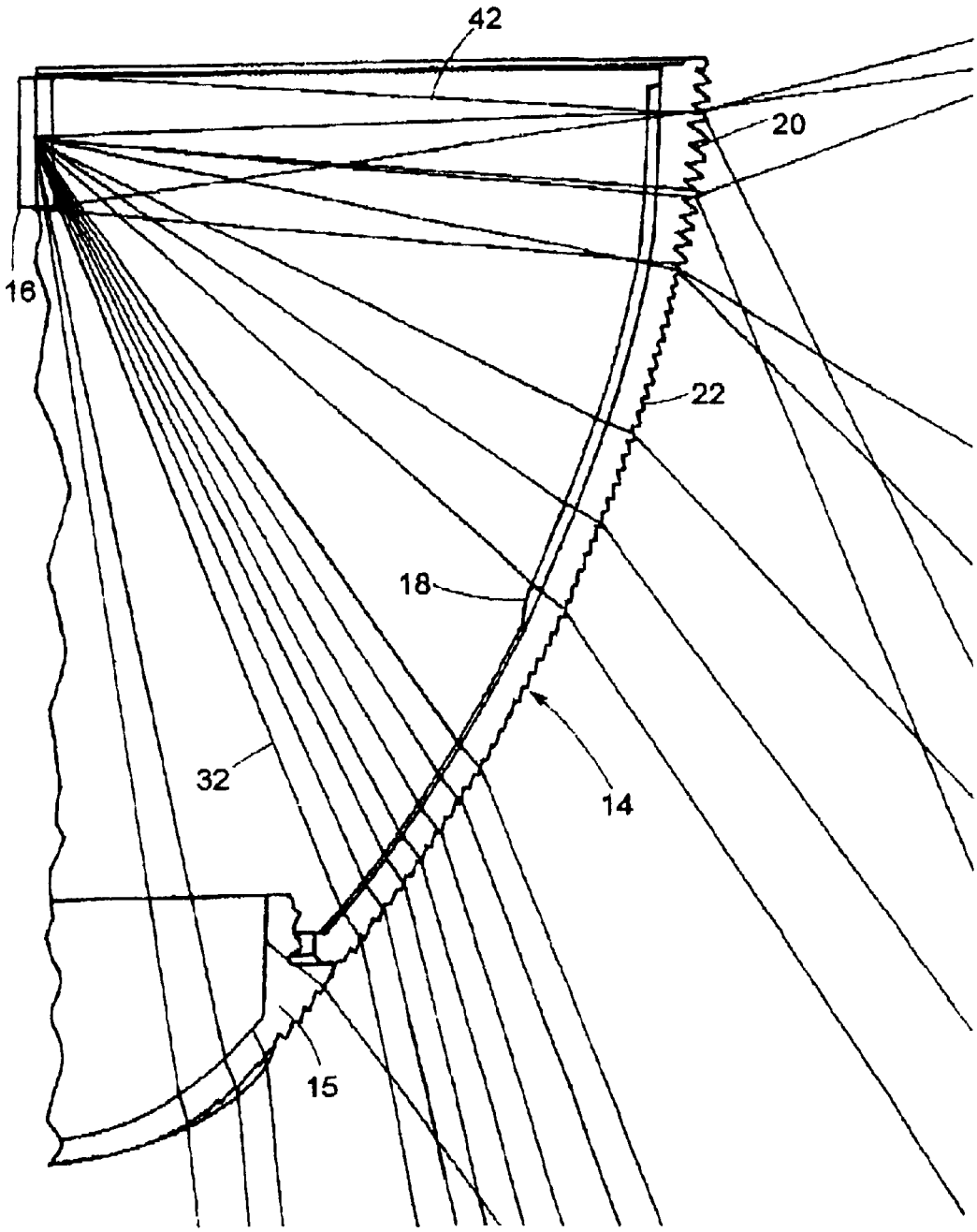
FIG. 8 is a schematic illustrating refraction of light incident on the refractor section of the globe member externally of said globe member.

FIG. 1 is particularly seen to show a pattern of light represented by light rays 28 emanating from a bottom portion of the arc tube of the light source 16. The rays 28 essentially impinge on the refractor section 14 at certain angles of incidence dependent upon the location of the light source 16 and on the downward and inward curvature of body portions of the refractor section 14. The prisms 20 and 22 act to refract the light rays 28 exteriorly of the globe member 10 as is best shown in FIG. 8 as will be described in detail hereinafter.

Referring to FIG. 2, light rays 30 are seen to emanate from a central portion of an arc tube of the light source 16, the pattern formed by the light rays 30 essentially being incident on surfaces of the refractor section 16 at incidence angles similar to the incidence angles of the light rays 28 shown in FIG. 1 which emanate from bottom portions of the light source 16.

Referring further to FIG. 3, light rays 32 are seen to emanate from a topmost portion of an arc tube of the light source 16 and to be incident on surfaces of the refractor section 14 in a pattern similar to the patterns of the light rays 28 and 30 as respectively illustrated in FIGS. 1 and 2, the angles of incidence of the light rays 32 being similar to the angles of incidence of the light rays 28 and 30. Essentially, FIGS. 1 through 3 illustrate the fact that light rays emanating from the light source 16 throughout its virtual height have similar angles of incidence on surfaces of the refractor section 14 depending upon location on said surfaces of the refractor section 14.

Figure 4:
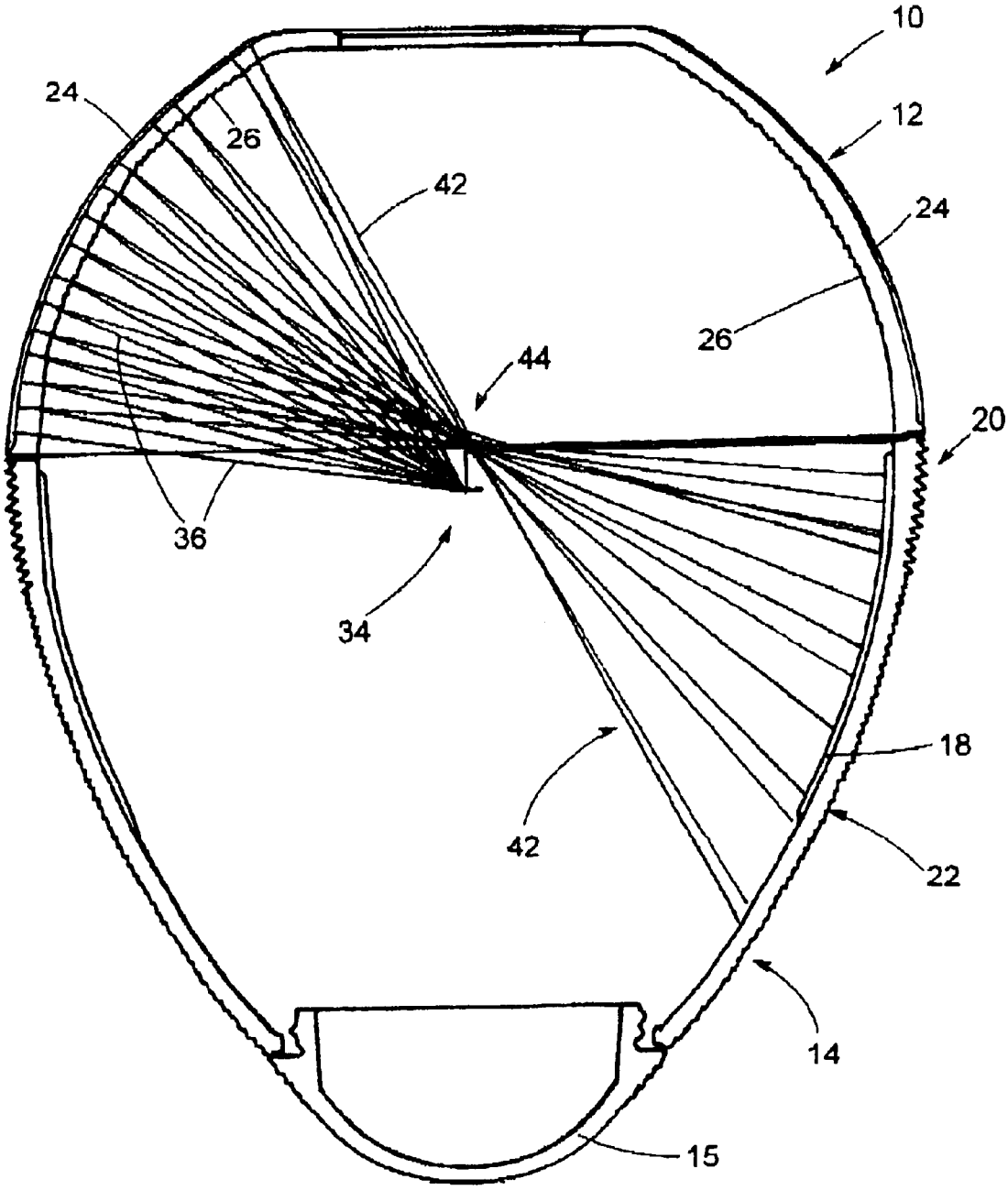
FIG. 4 is a schematic view representational of a ray trace from a central portion of a light source onto at least major portions of a reflector section of a globe member configured as a portion of a luminaire.
Figure 6:
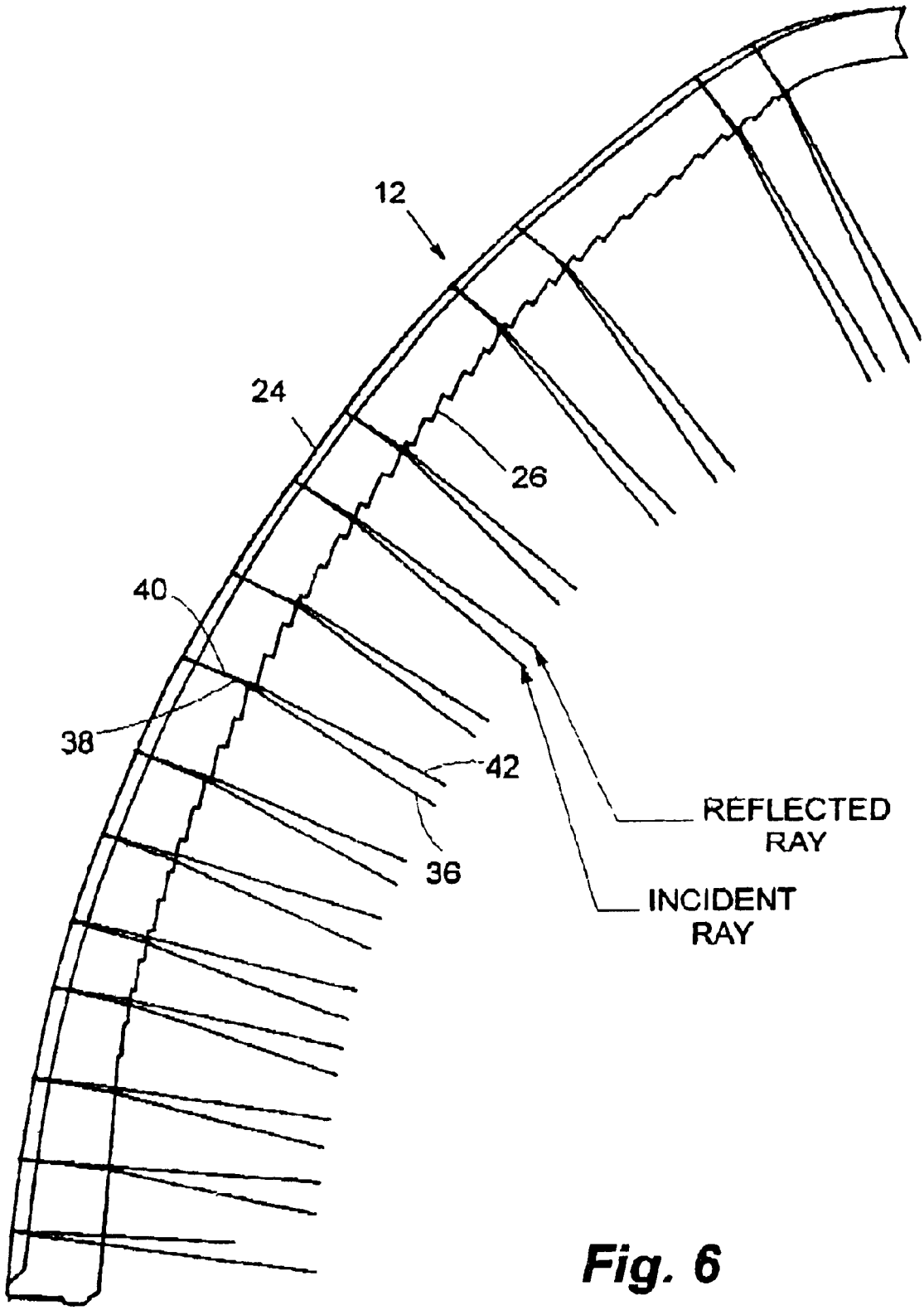
FIG. 6 is an enlarged schematic illustrating incident and reflective rays contacted and being directed from a portion of the reflector section of the globe member.
Figure 7:
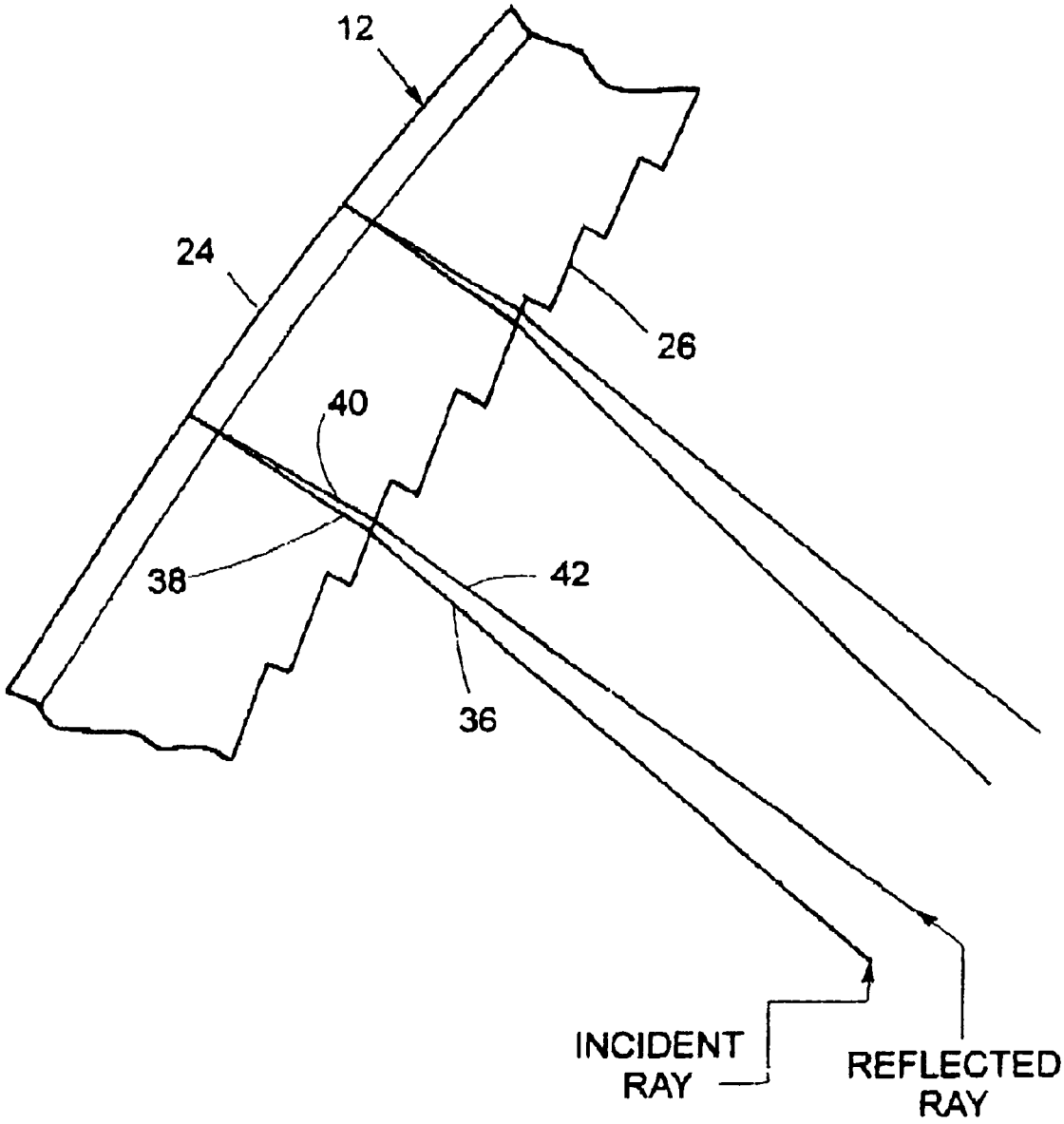
FIG. 7 is a detailed schematic illustrating light rays as shown relative to FIG. 6.

Referring now to FIG. 4, the globe member 10 is illustrated for simplicity without exact representation of a light source such as the light source 16 of FIGS. 1 through 3, an effective center of an arc tube of a virtual light source being represented at 34 with light rays 36 being represented as emanating from 34 to be incident on the refractive prisms 26, the light rays 36 being refracted by the refractive prisms 26 and then passing through wall portions of the reflector section 12 into incidence with the reflective prisms 24. FIGS. 6 and 7 show in respectively greater detail the structure of the refractive prisms 26 as well as the refraction of the light rays 36 to become light rays 38 which are incident on the reflective prisms 24. After reflection in a known manner by the reflective prisms 24, the light rays are represented at 40 and are incident on the refractive prisms 26. The refractive prisms 26 refract the light rays 40 to produce light rays 42, the light rays 42 being redirected as is shown in FIG. 4 into the interior of the globe member 10 and through a focal point at 44, the focal point 44 being essentially a loci of points in practical terms, this focal point 44 being disposed immediately above the light source such as is represented by the light source 16 of FIGS. 1 through 3 and in preferred embodiments lying on a longitudinal axis of the globe member 10. The focal point 44 is conveniently taken to be approximately 0.25 inch above a lamp arc tube of a light source such as the light source 16, this redirecting of light rays from central portions of a light source as represented at 34 back above the light source causes the refracted light rays 42 to be incident on surfaces of the refractor section 14 in a pattern similar to that formed by the light rays 20, 30 and 32 referred to hereinabove relative to FIGS. 1 through 3, that is, the pattern of light rays emanating directly from the light source 16 into incidence with surfaces of the refractor section 14. The focal point 44 or effectively that loci of points representing a virtual light source can range in location from the light source within a range of essentially null to approximately three inches. At a location of three inches the benefits of the invention begin to become negligible. It is to be understood that the invention contemplates redirection of light rays through a focal point or loci of points level with a lamp arc tube of alight source such as the light source 16 but to the side or sides thereof. Reference herein to the redirection of light above or immediately above a lamp arc tube of a light source such as the light source 16 is intended to refer to redirection of light as disclosed herein not only to the side or sides as noted above but also below the arc tube or a light source such as the light source 16.

The refractive prisms 26 are configured to accommodate the dual refraction thereby provided as well as reflection produced by the reflective prisms 24.

Figure 5:
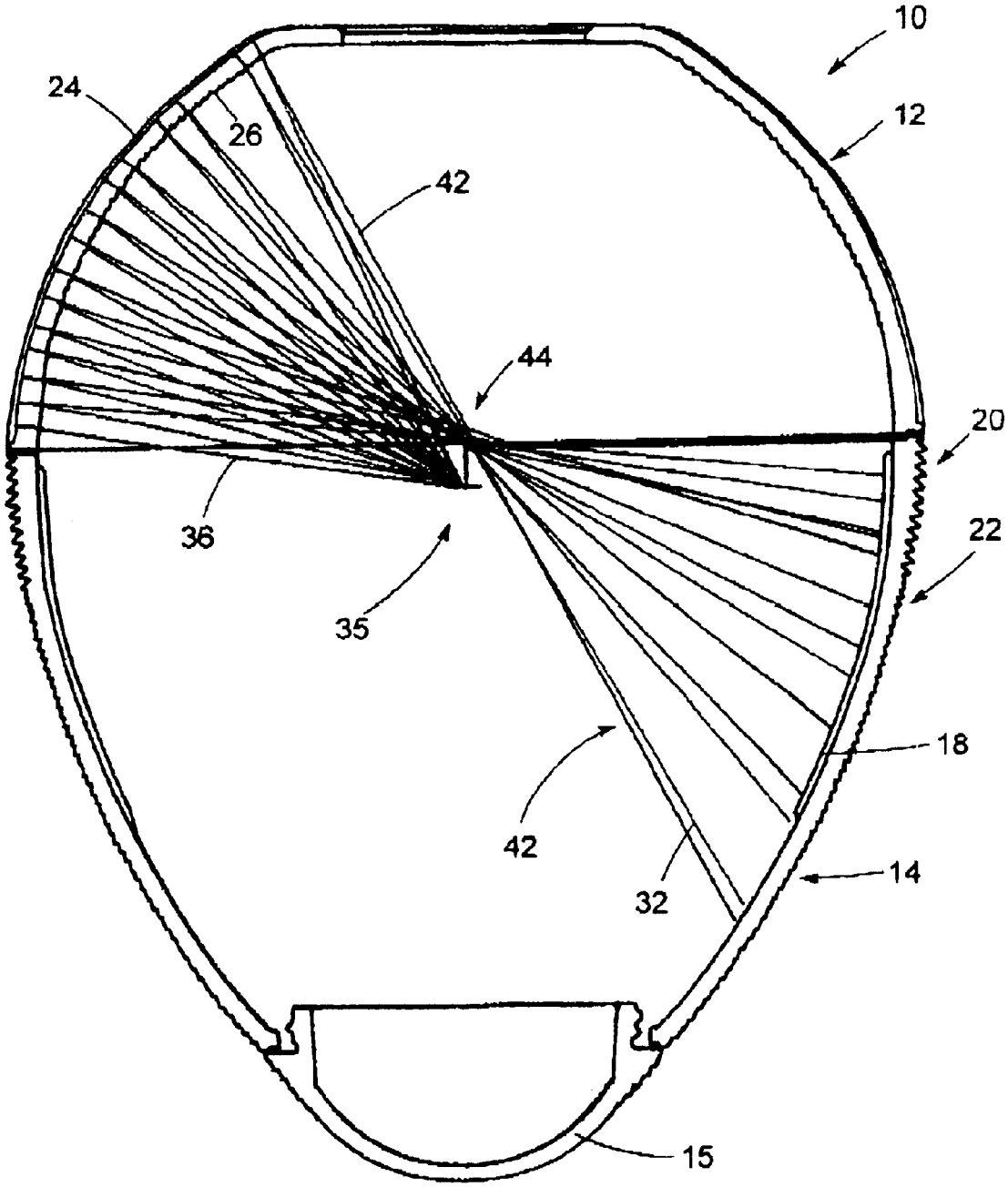
FIG. 5 is a schematic view representational of a ray trace emanating from the light source both to major surface portions of the reflector section of the globe member and directly onto the refractor section from a top portion of the light source.

As is seen in FIG. 5, light rays 36 emanating from the light source as represented at 35 are redirected in a manner essentially identical to those light rays emanating from central portions of the light source as represented at 34 in FIG. 4 to be represented by refracted rays such as the refracted rays 42 that are caused to pass through the focal point 44 and then on into incidence with surface portions of the refractor section 14. Light rays directly incident on the refractor section 14 are also seen in FIG. 5.

As can be seen in a comparison of FIGS. 1 through 3 with FIGS. 4 and 5, the pattern of the light rays 28, 30 and 32 that are directly incident on surfaces of the refractor section 14 have patterns that are similar to the patterns of the refracted light rays 42 that pass through the focal point 44 immediately above a lamp arc tube (not shown) of a light source regardless of the portion of the light source from which light rays pass to incidence with at least major portions of the reflector section 12 for redirection back through the focal point 44 located immediately above a light source such as the light source 16. This similar pattern of light rays or ray traces essentially results in similar angles of incidence of both light rays incident on surfaces of the refractor section 14, that is, the light rays 28, 30 and 32 emanating directly from the light source 16 and the refracted light rays 42 initially incident on surfaces of the reflector section 12 and redirected back through the focal point 44. These similar patterns are angles of incidence permits improved control of light striking the refractor section 14 and permits configuration of the refractive prisms 20, 22 so that light output in a desired distribution can be maximized.

As is particularly seen in FIG. 8, a representation is provided illustrating the effective incidence angles on surfaces of the refractor section 14 by light rays such as the light rays 32 emanating directly from the light source 16 and light rays such as the refracted, reflected and subsequently again refracted is the light rays 42 initially incident on at least major portions of surfaces of the reflector section 12 (seen in FIG. 1 inter alia) and which are thus redirected by the refractive prisms 26 through the focal point 44 located immediately above the light source 16, the rays 42 then being incident on surfaces of the refractor section 14 at angles of incidence similar to the angles of incidence of the light rays 32 inter alia, thereby permitting improved control of light emanating from the globe member 10 according to the teachings of the invention. It is to be understood that the distance of the focal point 44 or loci of points above the effective light source represented by the light source 16 can vary and is preferably within the range of up to 3 inches.

Figure 9:
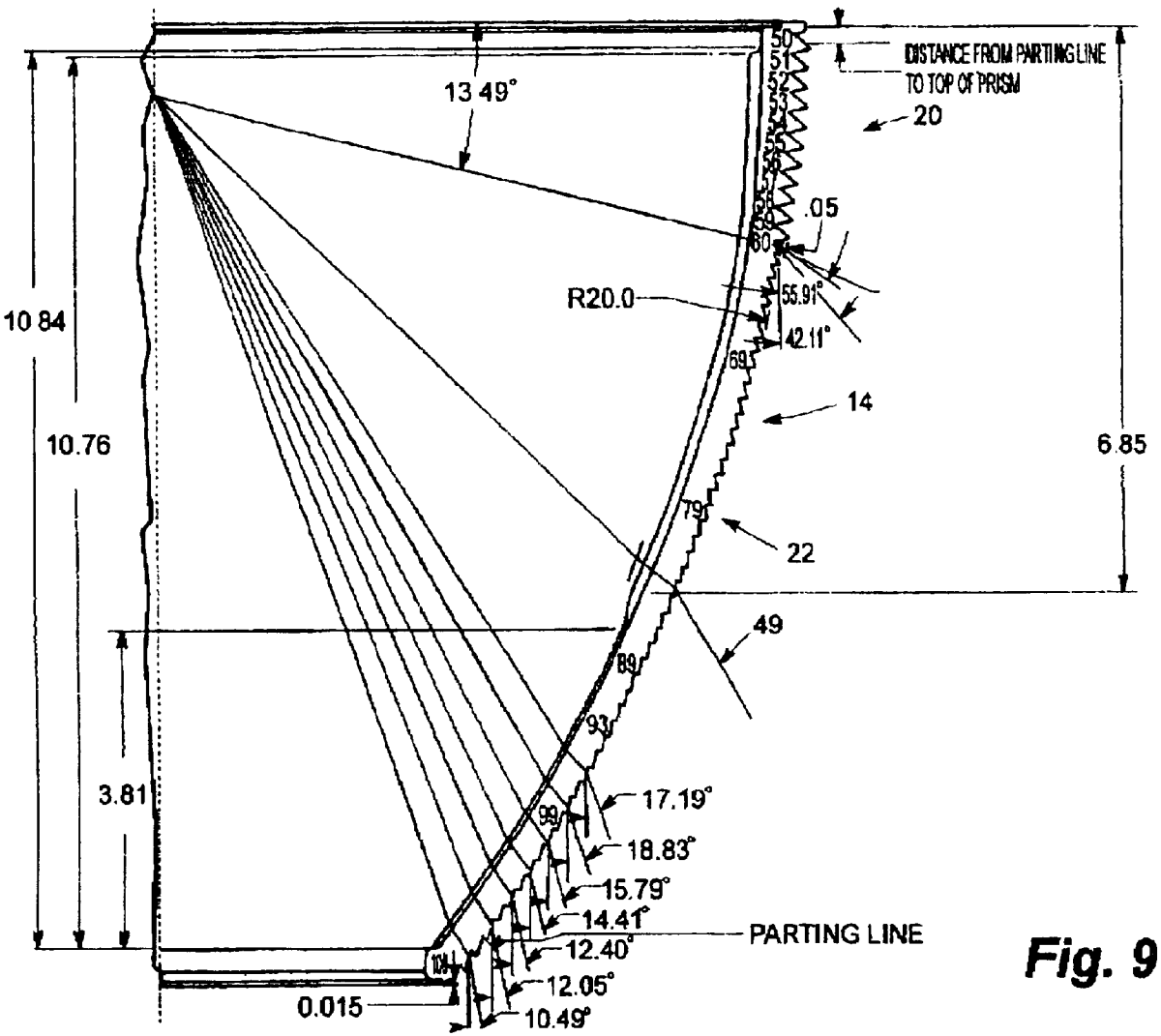
FIG. 9 is a detailed schematic illustrating the configurations of refractive prisms formed on exterior surfaces of the refractor section of FIG. 1.

Referring now to FIGS. 9 and 10, detailed information as to the structure of the prisms 20 and 22 such as are used in a preferred embodiment of the invention is provided The prisms 20 are seen to be splitter prisms as are described in detail in copending U.S. patent application Ser. No. 10/280,279, entitled "Prismatic Structures having Shaped Surfaces" as identified hereinabove. The splitter prisms 20 are identified individually in FIGS. 9 and 10 as splitter prisms 50 through 60 while the refractive prisms 22 are identified as prisms 61 through 109, it being understood that only a representative few of the numerals 61 through 109 are actually shown in FIG. 9 for ease of illustration. The prisms 22 not number in FIG. 9 can be readily determined as to identification by counting successive prisms The values A and B in the table of FIG. 10 indicate the value in degrees of angles associated with each of the prisms. The value A being an angular value defined by a counter clockwise angle for a line from each of the prisms to a convergence point of each such prisms and to an adjoining prism as is standardly known in the art. Similarly, the value B is an angular value defined by a clockwise angle from a line from each of the prisms to a convergence point of each such prism and to an adjoining prism as is standardly known in the art The value X in the table of FIG. 10 is the distance from a parting line at 120 to the top of each successive prism. The prisms 20 and 22 are formed by conventional processes using cutter tools (not shown) configured for particular groups of prisms such as is conventional in the art. The cutter angle for prisms identified in FIGS. 9 and 10 as 50 through 105 is perpendicular while the cutter angle for prisms identified as 106 through 109 is parallel. The prism height for each of the prisms identified in FIGS. 9 and 10 as 50 through 109 is given in the table of FIG. 10 Angles particularly identified in FIG. 9 are taken relative to respective top surfaces of the prisms and corresponding ray traces such as represented by ray trace 49, the ray traces emanating representationally from light center 48 as theoretically existing in the light source 16 referred to above.

Figure 11:
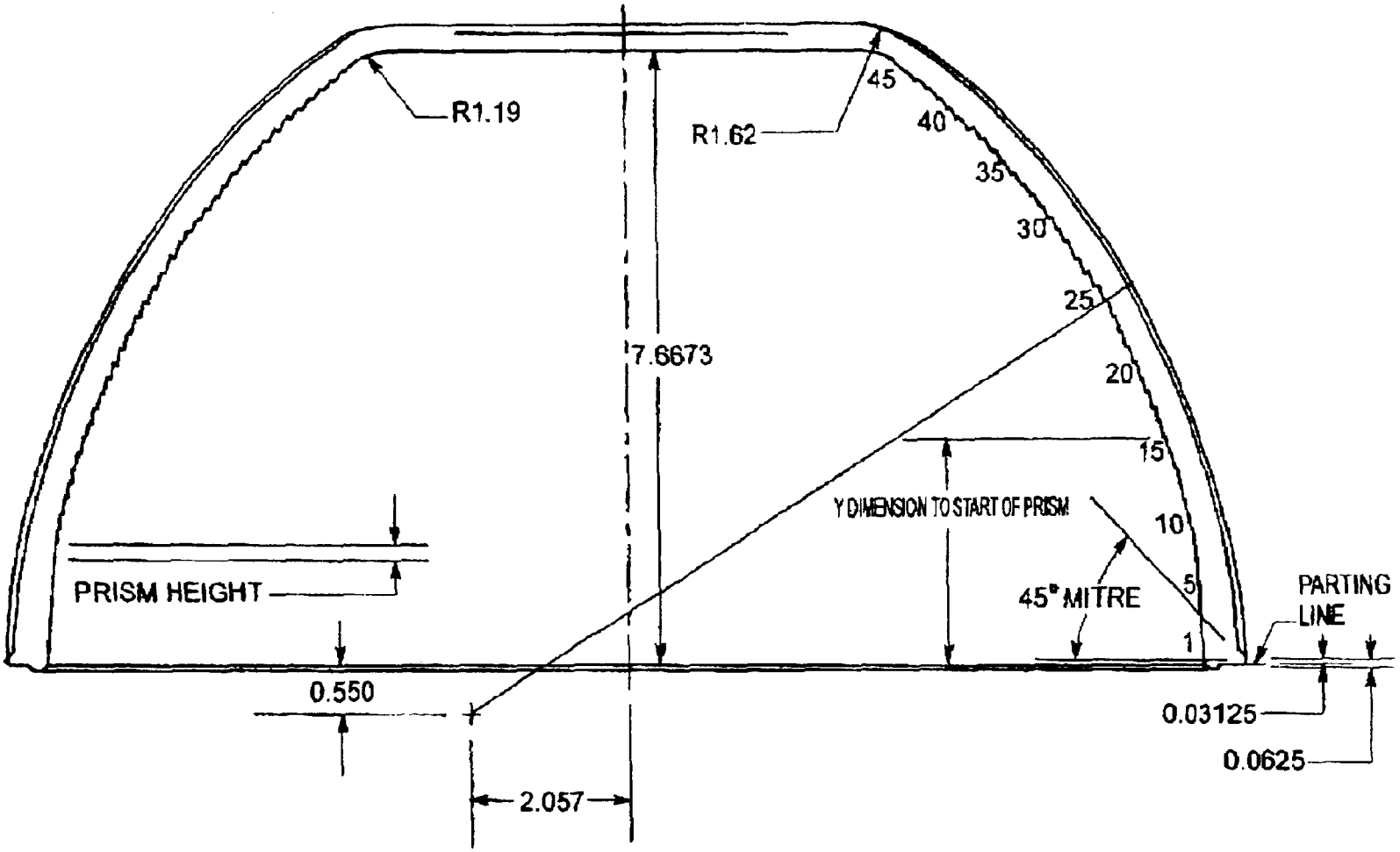
FIG. 11 is a detailed schematic illustrating the configurations of refractive prisms formed on interior surfaces of a preferred embodiment of the refractor section of FIG. 1.

Referring now to FIGS. 11 and 12, detailed information as to the structure of the prisms 26 of the reflector section 12 is provided The prisms 26 are identified as prisms 300 through 344 in the table of FIG. 12 with only certain prisms being numbered for convenience in FIG. 11 The prisms 26 not numbered in FIG. 11 can be readily determined as to identification by counting successive prisms. The values A and B in the table of FIG. 12 indicate the value in degrees of angles associated with each of the prisms, the value A being an angular value defined by a counter clockwise angle from a line firm each of the prisms to a convergence point of each such prism and to an adjoining prism as is standardly known in the art. Similarly, the value B is an angular value defined by a clockwise angle from a line from each of the prisms to a convergence point at each such prism and to an adjoining prism as is a customary designation in the art. The value Y in the table of FIG. 12 is the distance from a parting line at 345 in FIG. 11 to the top of each successive prism. The prisms 26 are formed by conventional processes using cutter tools (not shown) configured for particular groups of prisms such as is known in the art. The cutter angle for the prism identified in FIGS. 11 and 12 as 300 through 307 is perpendicular while the cutter angle for the prisms identified as 308 through 337 is 45° The cutter angle for the prisms identified as 338 through 344 is parallel. The prism height for each of the prisms identified in FIGS. 11 and 12 as 300 through 344 is given in the table of FIG. 12 The reflector section 12 preferably has a total of 240 of the reflective prisms 24 formed on exterior surfaces thereof for the size and shape of the reflector section 12 as noted by dimensions provided in FIG 11.

Figure 14:
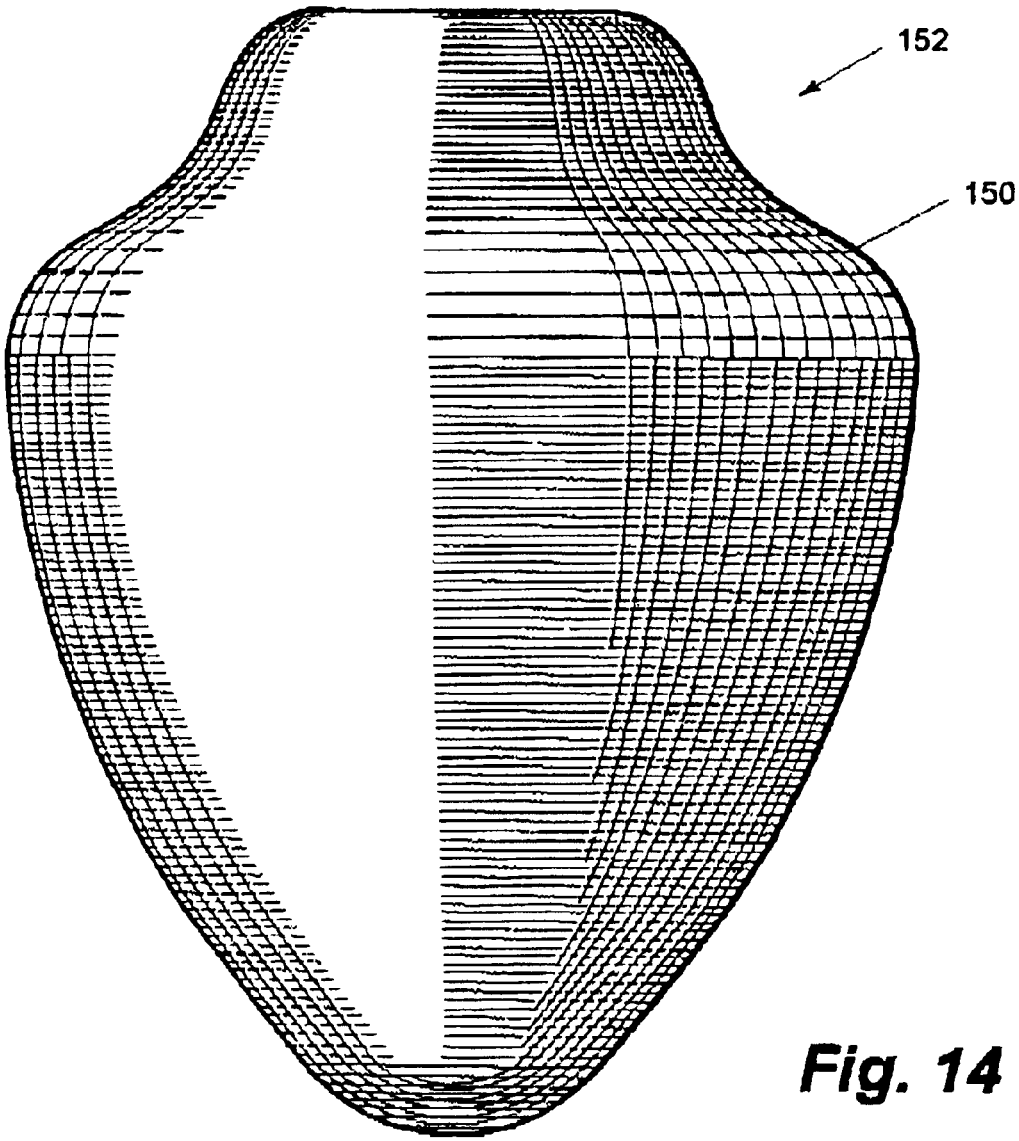
FIG. 14 is an elevational view of a globe member of a particular shape and constituting another embodiment of the invention.
Figure 15:
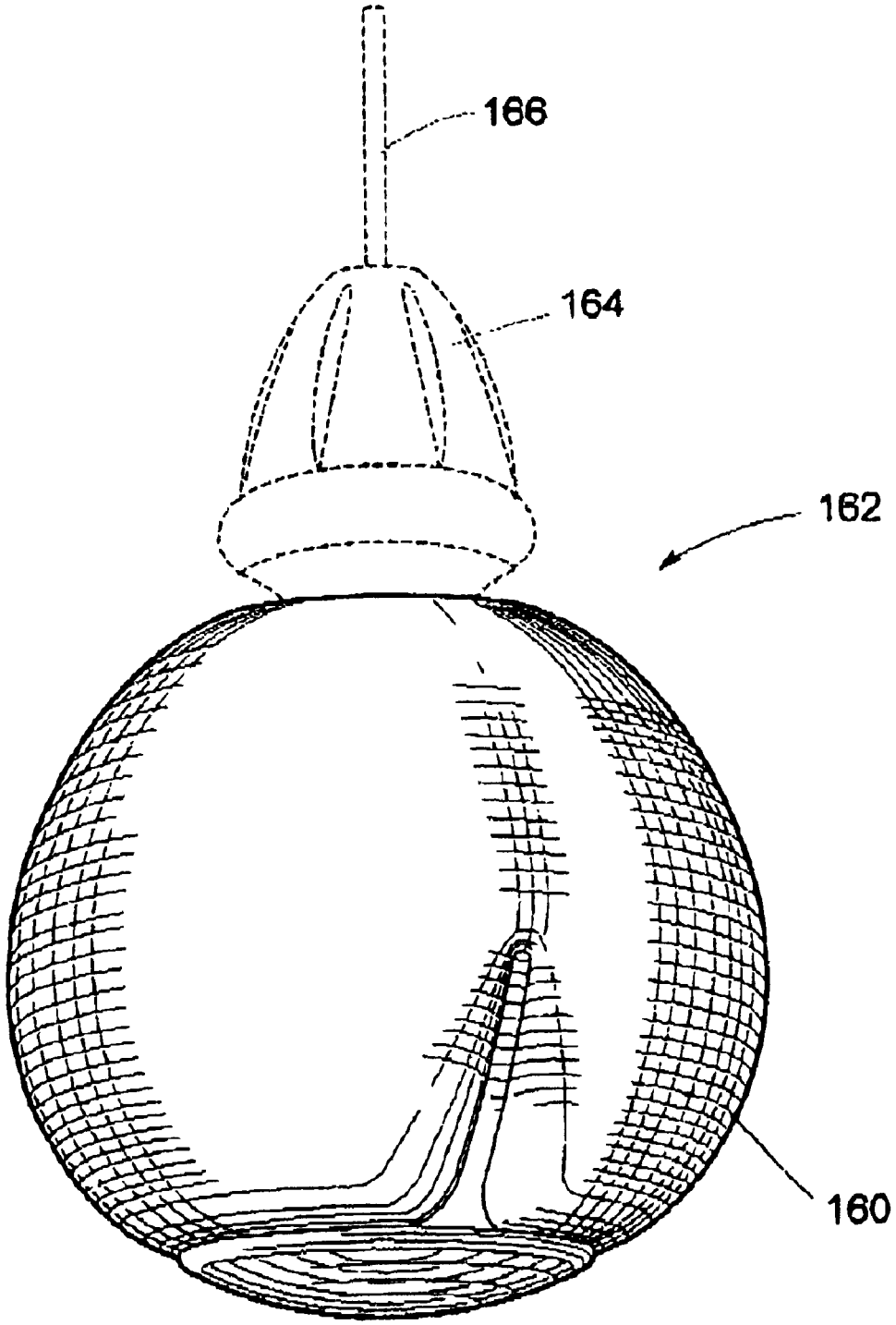
FIG. 15 is an elevational view of a globe member shaped according to a further embodiment.

The shape of the reflector section 12 can vary based on considerations of appearance as well as the handling of light as will be apparent to the practitioner in the art. Further, the shape of the refractor section 14 can also vary based on similar considerations. As can be seen in FIGS. 14 through 17, alternate shapes of reflector and refractor sections, as well as combinations of such sections, are shown. In FIG. 14, a reflector section 150 is seen to be combined in a globe 152 with a refractor section that is essentially identical to the refractor section 14 referred to above. In FIG. 15, a refractor section 160 is seen to be combined in a globe 162 with a reflector section that is essentially identical to the reflector section 12 referred to above. The globe 162 is seen in association with a ballast housing 164 and mounting rod 166 shown in broken lines in order to illustrate the globe 162 in a use situation.

Figure 16:
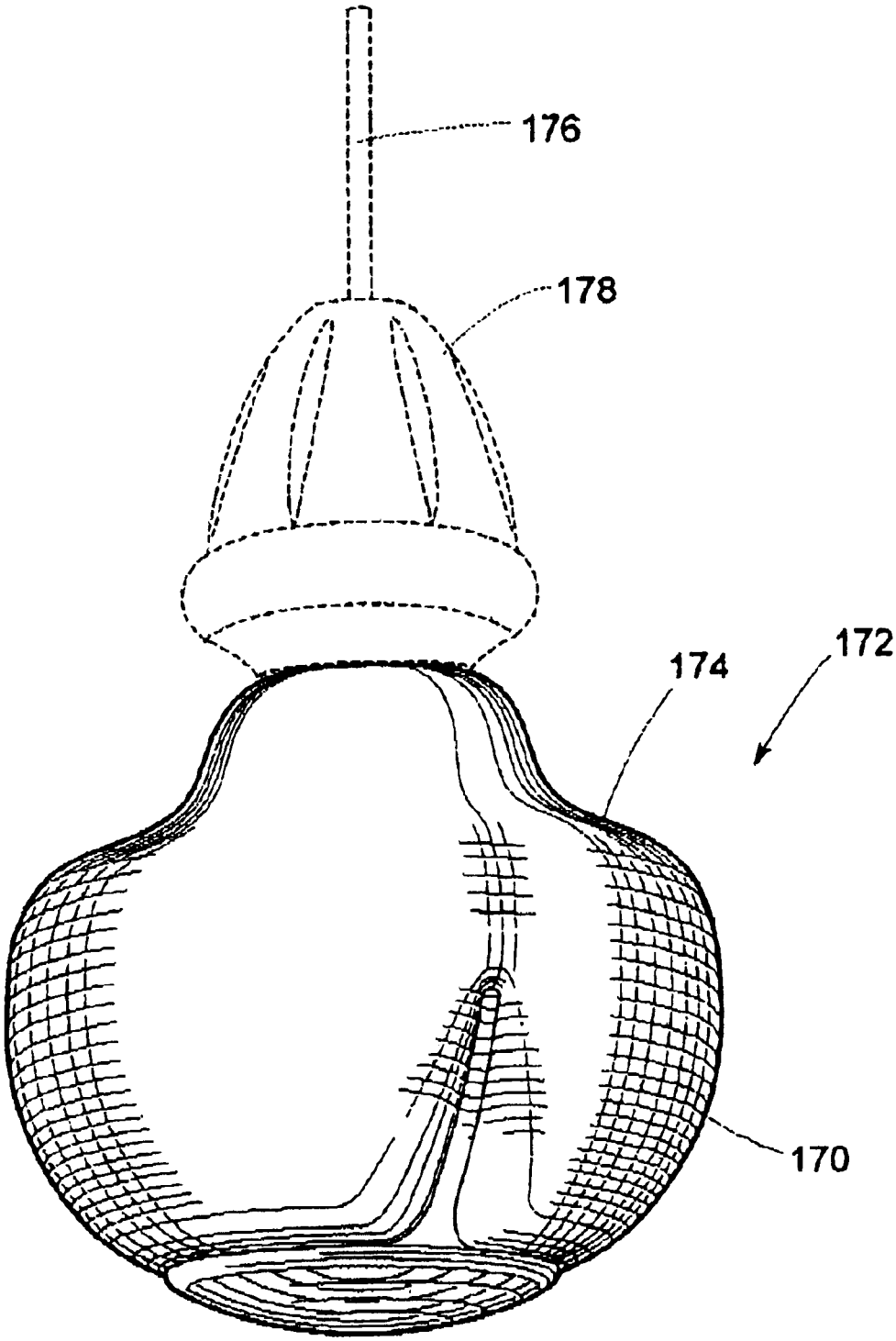
FIG. 16 is an elevational view of a globe member shaped according to yet another embodiment of the invention.
Figure 17:
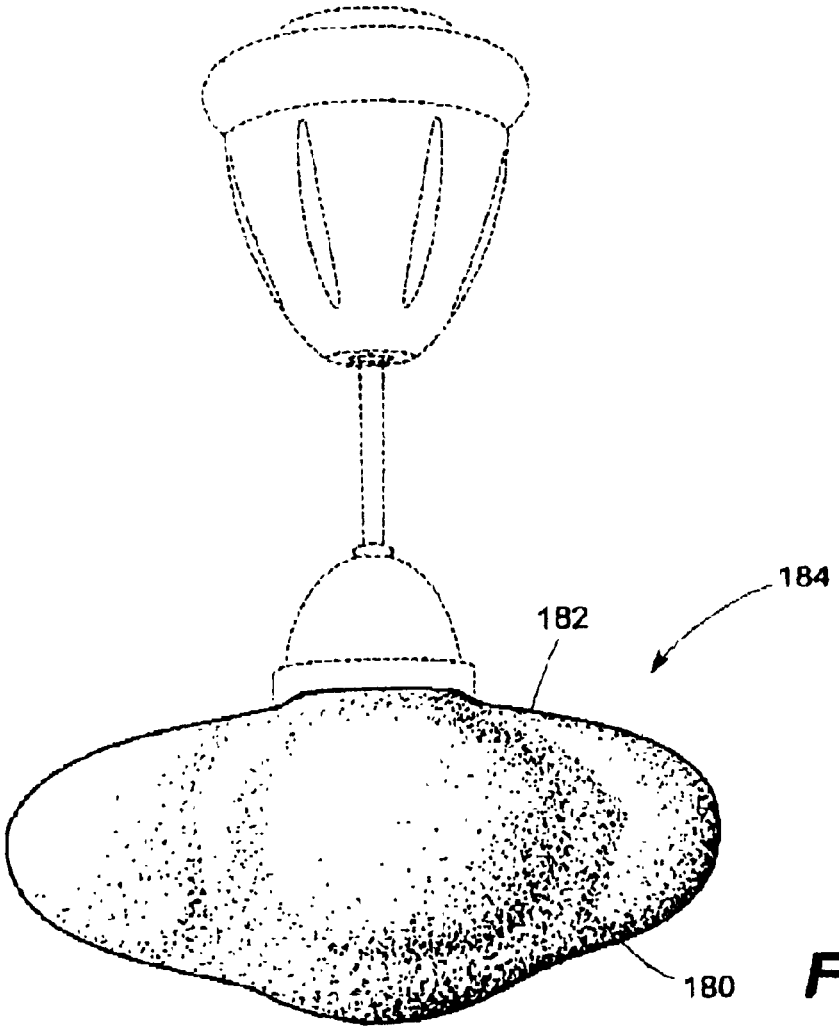
FIG. 17 is an elevational view of a globe member shaped according to another embodiment of the invention.

In FIG. 16, a refractor section 170 is seen to be combined in a globe 172 with a refractor section 174 that is essentially identical to the reflector section 150 of FIG. 11. The refractor section 170 is seen to be essentially identical to the refractor section 160 of FIG. 12. The globe 172 is seen to be mounted by mounting rod 176 and a ballast housing 178 in suspended fashion, the rod 176 and the housing 178 being shown in broken lines. In FIG. 17, a refractor section 180 and a reflector section 182 form a globe 184, the globe 184 being mounted by structure shown in broken lines. It is to be understood that the globes 152, 162, 172 and 184 are shown without an indication of a dividing line between respective reflector and refractor sections. Further, the globes 152, 162, 172 and 184 are seen to have prisms formed on exterior surfaces thereof in a manner similar to that shown and described herein relative to the globe member 10. As will be evident to the practitioner given the disclosure herein provided, the reflector and refractor sections can take a number of differing shapes consistent with considerations of appearance and desired lighting performance.

It is further to be understood that the invention contemplates the redirection of portions of the light emanating from the light source 16 of FIG. 1, for example, differently, that is, a portion of the light incident on the reflector section 12 being redirected above the light source 16 while another portion of the light incident on the reflector section 12 can be redirected below the light source or to the side thereof. Still further, it is to be understood that a stepped reflector (not shown) could be utilized to produce the function of the reflector section 12 in whole or in part, the intent of the invention being as aforesaid to redirect light incident on at least a major portion of a reflective element back into the interior of a globe member and through at least one focal point or loci of points and into incidence with at least major surface portions of a refractor section in a pattern or patterns similar to patterns of light emanating from differing portions of a light source and directly incident on said refractor surface portions in order to control light distribution and improve lighting efficiency. When utilizing reflective prisms such as the reflective prisms 24 of FIG. 1 inter alia, it is to be understood that the preferred 90° angle of such prisms can vary in a range about 90° while retaining the benefits of the invention, such a range being between, for example, 88° to 92°. When other than 90°, an "opening" of the prisms, that is, a forming of the prisms at angles greater than 90° or a "closing" of at least some of the prisms, that is, a forming of the prisms at angles less than 90° without departing from the intended scope of the invention.

Figure 18:
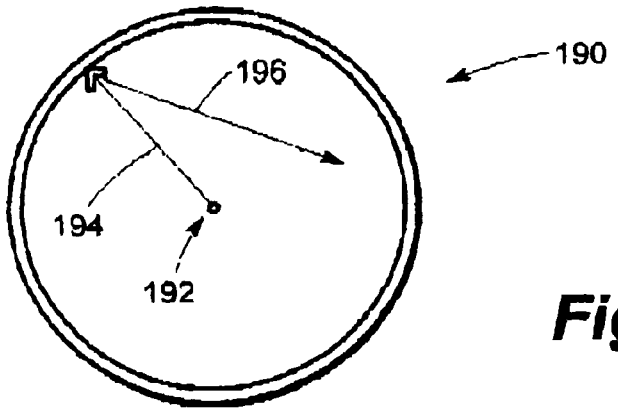
FIG. 18 is a schematic illustrating a further embodiment of the invention.

Reference is now made to FIG. 18 which is a schematic of a globe 190 seen in section from a position along a longitudinal axis thereof such that the globe 190 is seen as a circular structure. The effective center of the globe 190 and the plane of the schematic of FIG. 18 is seen at 192 to be essentially coincident with the center 192, a light ray 194 representing a ray from the light source and onto a reflector section such as the reflector section 12 of FIG. 1 inter alia being redirected as light ray 196 passing to the side of the light source at the center 192. A focal point through which the redirected light ray 196 passes is thus to the side of the light source, a reflector section providing such function differing from the specific reflector section 12 of FIG. 1 inter alia. In the embodiment of FIG. 18, prisms (not shown) or other reflective structure are configured to facilitate light redirection as indicated. As is apparent from the foregoing, different portions of the light emanating from a light source can be redirected through differing focal points or loci of points as desired. Preferred function occurs according to the teachings of the invention from a redirection of light immediately above the light source as has been particularly described herein.

Figure 19:
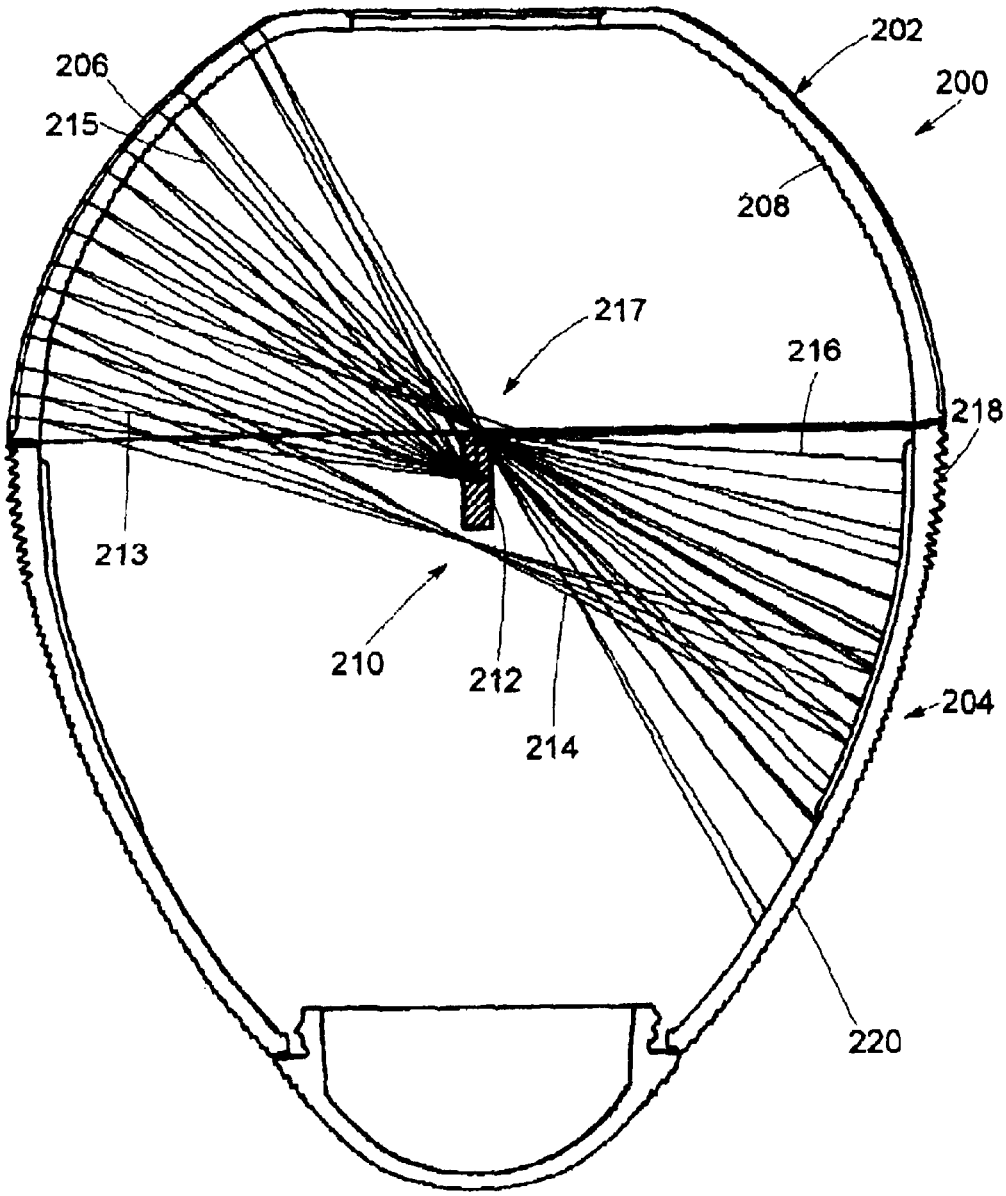
FIG. 19 is a schematic view illustrating yet another embodiment of the invention.

Referring now to FIG. 19, a globe member 200 is seen to have a reflector section 202 and a refractor section 204 configured similarly to corresponding structure shown in FIG. 1 inter alia. However, in the globe member 200 of FIG. 19, reflective prisms 206 and refractive prisms 208 redirect at least some light represented by trace 213 through a focal point 210 below or immediately below arc tube 212 rather than above an arc tube or light source such as is shown relative to the embodiment of FIG. 1 inter alia. Light thus redirected by the reflector section 202 passes through the focal point 210 or loci of points thereabout and onto the refractor section 204 in a pattern of light rays, represented by the ray trace 214, that is similar to the pattern of light, represented by the ray trace 216, that is directly incident on the refractor section 204 as said light emanates from the arc tube 212. Refractive prisms 218 and 220 formed on the refractor section 204 in a manner of a kind similar to corresponding prisms of the embodiment of FIG. 1 inter alia then distribute light downwardly from the globe member 200 in a desired manner. It is to be understood that essentially all light incident on the reflector section 202 could be redirected through the focal point 210 rather than only a portion thereof as shown in FIG. 19 wherein portions of that light, as represented by ray trace 215, is redirected through a focal point 217 above or immediately above the arc tube 212 as disclosed hereinabove.

Figure 20:
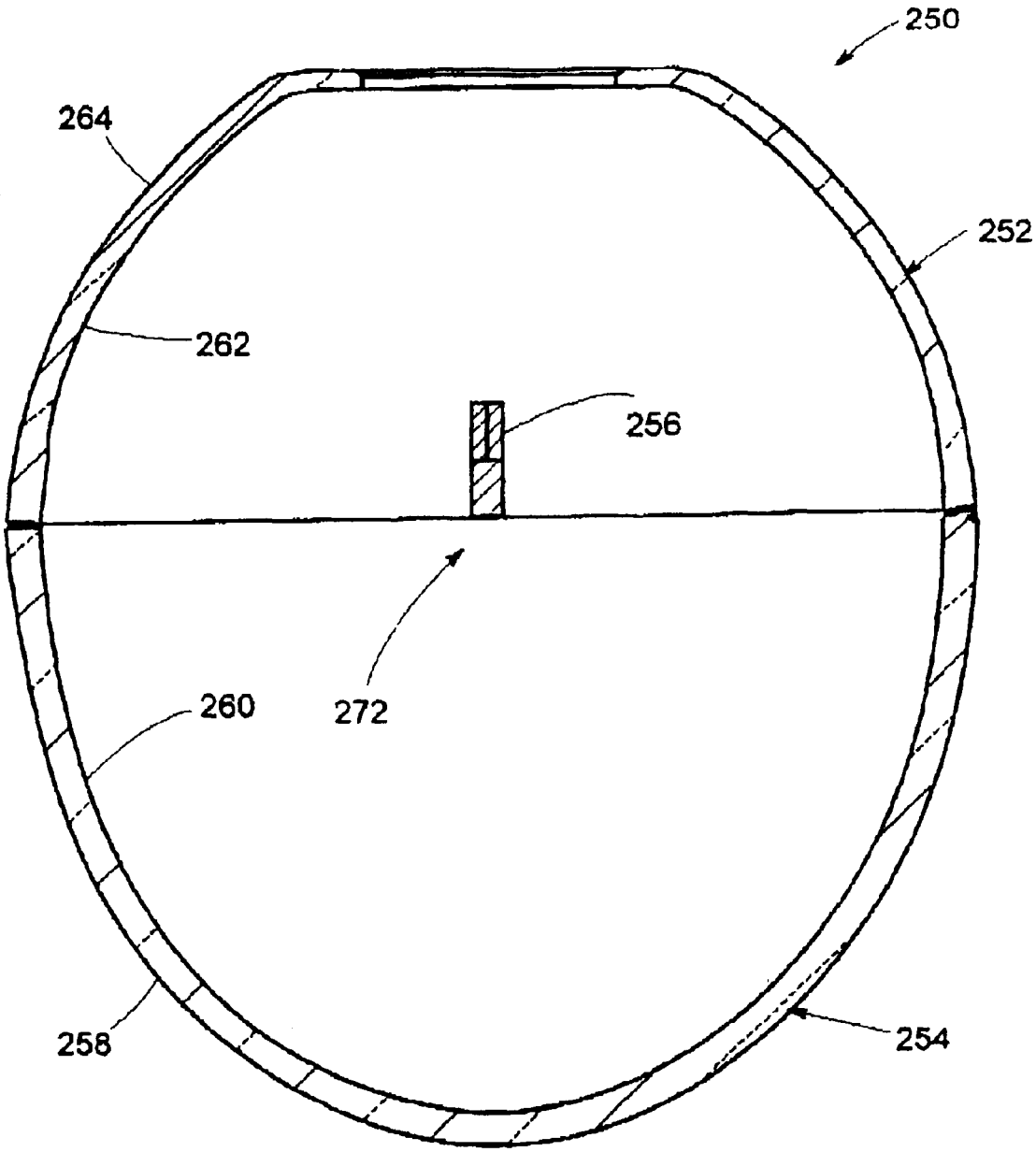
FIG. 20 is a schematic view illustrating a still further embodiment of the invention

Referring now to FIG. 20, a globe member 250 representative of such a member useful in an indirect luminaire (not shown per se) is seen to be formed of a reflector section 254 and a refractor section 252, the sections 254 and 252 being inverted in orientation in a use environment relative to the embodiment of FIG. 1 inter alia. In an illumination situation wherein the globe member 250 finds utility. "uplight" is desirably produced such that illumination of an environmental space is "indirect", a general concept known in the art. In the globe member 250, light front the arc tube 256 that is incident on the reflector section 254 is largely redirected below the arc tube 256 and onto the refractor section 252 in a pattern similar to the pattern of light directly incident on the refractor section 252 from the arc tube 256. That light passing through the reflector section 254 causes the reflector section 254 to have a luminous appearance of "glow" as is desirable in the art However, the globe member 250 is intended to function in a manner such that light directly incident on the reflector section 254 from the arc tube 256 is redirected upwardly to the refractor section 252 for distribution in a desired manner upwardly of the globe member 250 in a use environment wherein indirect illumination is desired. Restated therefore, the relative positions of the reflector section 254 and the refractor section 252 are opposite that of the reflector section 12 and the refractor section 14 of FIG. 1 inter alia.

While not shown in detail in FIG. 20 for convenience of illustration, the reflector section 254 has reflective prisms 258 formed on at least portions of exterior surfaces thereof in a manner and of a kind similar to the reflective prisms 24 of FIG. 1 inter alia as will be understood by a person of ordinary skill in the art once such a person is subjected to the present disclosure. Similary, the reflector section 254 has refractive prisms 260 formed on at least portions of interior surfaces thereof, the prisms 260 being of a kind similar to the refractive prisms 26 of FIG. 1 inter alia. In a similar fashion, the refractor section 252 can have reflective prisms 262 formed on at least portions of the interior surface thereof in a manner and of a kind similar to the reflective prisms 18 of the embodiment of FIG. 1 inter alia. The refractor section 252 can further have refractive prisms 264 formed on at least portions of exterior surfaces thereof in a manner and of a kind similar to the refractive prisms 20 and 22 of the embodiment of FIG. 1 inter alia. It is to be understood that a stepped aluminum (or other) reflector (not shown) could be utilized to provide the function of the reflector section 254. such a reflector being perforated as desired to permit light to pass through the reflector section 254 for purposes of appearance inter alia. A combination of prisms and a metal or other reflector could also be employed in this embodiment as well as in other embodiments of the invention. Still further, certain or all surfaces of certain or all prisms formed on the reflector section 254 could be coated with a reflective layer (not shown), such as a reflective metallized layer or finish.

The globe member 250 as so configured in the generally exemplary embodiment of FIG. 20 functions to redirect at least a portion of the light emanating from the arc tube 256 and incident on the reflector section 250 back through a focal point 272, or loci of points, below or immediately below the arc tube 252 in a fashion similar to the manner in which light is redirected as aforesaid in the embodiment of FIG. 1 inter alia immediately above or above an arc tube or light source, light exiting the refractor section 252 of FIG. 20 being directed upwardly from the globe member 250 as opposed to the generally downward direction of light from the globe member 10 of FIG. 1 inter alia. A luminaire utilizing the globe member 250 would therefore be generally considered to an indirect luminaire or, in luminaires appropriately configured, a combination direct/indirect luminaire.

As is seen in FIG. 20, light rays 270 emanating from a light source as represented by the arc tube 256 are redirected by the reflector section 254 in a manner essentially identical to those light rays emanating from central portions of the arc tube 250 to be represented by refracted rays 266 that pass through the focal point 272 and then on into incidence with surface portions of the refractor section 252. Light rays directly incident on the refractor section 252 are seen representationally at 268 in FIG. 20. As aforesaid, the light rays 266 are redirected from the reflector section 254 onto the refractor section 252 in a pattern similar to the pattern of the light rays 268 that are directly incident on the refractor section 252 as emanating from the arc tube 256.

It is to be understood that the invention has been described herein relative to particular embodiments thereof, the invention being otherwise susceptible to practice other than as explicitly shown. As an example, the globe members of the invention need not be circular in cross-section but can be otherwise configure. the scope of the invention being determinable by the definitions provided by the appended claims.

What is claimed is:

1. A method for controlling distribution of light from a light transmissive globe member of a luminaire having a light source disposed within the globe member, the light source being located within the globe member at a position level with, essentially above or essentially below certain first portions thereof through which light passes for illumination of a space exteriorly of the globe member, light emanating directly from the light source onto at least portions of said first portions of the globe member having a first pattern of angles of incidence thereon, comprising the step of redirecting at least a portion of light incident on at least certain second portions of the globe member level with, essentially located above or essentially located below the light source back into the interior of the globe member to form a second pattern of angles of incidence onto said first portions of the globe member that is similar to the first pattern, at least major portions of the light passing from the globe member being more efficiently controlled and distributed from the globe member wherein the redirected light is caused to pass through a point or loci of points located above the light source.

2. The method of claim 1 wherein the second portions of the globe member have reflective and refractive elements formed thereon, light from the light source incident thereon being reflective back into the interior of the globe member and redirected by the refractive elements to the first portions of the globe member.

3. The method of claim 2 wherein the first-mentioned portions of the globe member have refractive elements formed thereon for directing light exteriorly of the globe member in directions maximizing effective light output from the globe member.

4. The method of claim 3 wherein the reflective and refractive elements are prisms.

5. The method of claim 1 wherein the redirected light is caused to pass through a point or loci of points located to a side or to sides of the light source.

6. The method of claim 1 wherein the redirected light is caused to pass through a point or loci of points located below the light source.

7. The method of claim 1 wherein the second-mentioned portions of the globe member have reflective and refractive elements formed thereon, light from the light source incident thereon being reflected back into the interior of the globe member and redirected by the refractive elements to the first-mentioned portions of the globe member.

8. The method of claim 7 wherein the first-mentioned portions of the globe member have refractive elements formed thereon for directing light exteriorly of the globe member in directions maximizing effective light output from the globe member.

9. The method of claim 7 wherein the reflective and refractive elements are prisms.

10. The method of claim 9 wherein the redirected light is caused to pass through a point or loci of points located immediately above the light source.

11. The globe member of claim 1 wherein the light transmissive material is selected from the group consisting of glass and polymeric material suitable for function as portions of the globe member.

12. A globe member of a luminaire formed of a light transmissive material and having a light source disposed therewithin at a position level with or essentially above first portions thereof through which light passes for illumination of a space exteriorly of the globe member, light emanating directly from the light source onto at least portions of said first portions of the globe member having a first pattern of incidence angles thereon, comprising:

first means formed on second portions of the globe member redirecting light incident thereon from interior portions of the globe member back into the interior of the globe member to form a second pattern of incidence angles on said first portions of the globe member, the first and second patterns being similar; and, second means formed on said first portions of the globe member for redirecting light incident thereon externally of the globe member, the similarity of angles of incidence of light incident on the first portions of the globe member in said first and second patterns permitting improved control of light distribution from the globe member wherein light redirected from the second portions of the globe member is caused to pass through a focal point or loci or points above the light source.

13. The globe member of claim 12 wherein the focal point or effective center of the loci of points is disposed approximately 0.25 inch above the light source.

14. The globe member of claim 12 wherein the first means comprise reflective and refractive prisms.

15. The globe member of claim 12 wherein the second means comprise refractive prisms.

16. The globe member of claim 15 wherein the first means comprise reflective and refractive prisms.

17. The globe member of claim 16 wherein light redirected from the second portions of the globe member is caused to pass through a focal point or loci of points above the light source.

18. The globe member of claim 17 wherein the focal point or effective center of the loci of points is disposed approximately 0.25 inch above the light source.

19. The globe member of claim 18 wherein at least certain of the refractive prisms comprise splitter prisms.

20. The globe member of claim 19 wherein the light source comprises a high intensity discharge lamp.

21. The globe member of claim 12 wherein the light transmissive material is selected from the group consisting of glass and polymeric materials suitable for function as portions of the globe member.

22. The globe member of claim 12 wherein the light redirected from the second portions of the globe member is caused to pass through a focal point or loci of points located to a side or to sides of the light source.

23. The globe member of claim 12 wherein the light redirected from the second portions of the globe member is caused to pass through a focal point or loci of points located below the light source.

24. A method for controlling distribution of light from a light transmissive globe member of a luminaire having a light source disposed within the globe member, the light source being located within the globe member at a position level with or essentially above certain first portions thereof through which light passes for illumination of a space exteriorly of the globe member, light emanating directly from the light source onto at least portions of said portions of the globe member having a first pattern of angles of incidence thereon, comprising the step of redirecting light incident on at least certain second portions of the globe member essentially located above the light source back into the interior of the globe member to form a second pattern of angles of incidence onto said first portions of the globe member that is similar to the first pattern, at least major portions of the light passing from the globe member being more efficiently controlled and distributed from the globe member wherein the redirected light is caused to pass through a point or loci of points located immediately above the source.

25. A method for controlling distribution of light from a light transmissive globe member of a luminaire having a light source disposed within the globe member, the light source being located within the globe member at a position level with, essentially above or essentially below certain first portions thereof through which light passes for illumination of a space exteriorly of the globe member, light emanating directly from the light source onto at least portions of said first portions of the globe member having a first pattern of angles of incidence thereon, comprising the step of redirecting at least a portion of light incident on at least certain second portions of the globe member level with, essentially located above or essentially located below the light source back into the interior of the globe member to form a second pattern of angles of incidence onto said first portions of the globe member that is similar to the first pattern, at least major portions of the light passing from the globe member being more efficiently controlled and distributed from the globe member wherein the redirected light is caused to pass through a point or loci of points located to a side or to sides of the light source.

26. The method of claim 25 wherein the second portions of the globe member have reflective and refractive elements formed thereon, light from the light source incident thereon being reflected back into the interior of the globe member and redirected by the refractive elements to the first portions of the globe member.

27. The method of claim 26 wherein first portions of the globe member have refractive elements formed thereon for directing light exteriorly of the globe member in directions maximizing effective light output from the globe member.

28. The method of claim 27 wherein the reflective and refractive elements are prisms.

29. A method for controlling distribution of light from a light transmissive globe member of a luminaire having a light source disposed within the globe member, the light source being located within the globe member at a position level with, essentially above or essentially below certain first portions thereof through which light passes for illumination of a space exteriorly of the globe member, light emanating directly from the light source onto at least portions of said first portions of the globe member having a first pattern of angles of incidence thereon, comprising the step of redirecting at least a portion of light incident on at least certain second portions of the globe member level with, essentially located above or essentially located below the light source back into the interior of the globe member to form a second pattern of angles of incidence onto said first portions of the globe member that is similar to the first pattern, at least major portions of the light passing from the globe member being more efficiently controlled and distributed from the globe member wherein the redirected light is caused to pass through a point or loci of points located below the light source.

30. The method of claim 29 wherein the second portions of the globe member have reflective and refractive elements formed thereon, light from the light source incident thereon being reflected back into the interior of the globe member and redirected by the refractive elements to the first portions of the globe member.

31. The method of claim 30 wherein first portions of the globe member have refractive elements formed thereon for directing light exteriorly of the globe member in directions maximizing effective light output from the globe member.

32. The method of claim 31 wherein the reflective and refractive elements are prisms.

* * * * *